United States Patent [19]

Baum et al.

[11] 4,042,319

[45] Aug. 16, 1977

[54] DYE-BATH OXIDANTS

[75] Inventors: Elliot H. Baum, Spring Valley, N.Y.; Gerald R. Ferrante, Edison, N.J.

[73] Assignee: Kewanee Industries, Bryn Mawr, Pa.

[21] Appl. No.: 731,117

[22] Filed: Oct. 12, 1976

[51] Int. Cl.[2] ..... C09B 9/00; C09B 49/00; D06P 1/22; A61L 13/00

[52] U.S. Cl. ..... 8/35; 8/34; 8/37; 8/54.2; 252/186

[58] Field of Search ..... 8/35, 34, 37; 252/186

[56] References Cited

U.S. PATENT DOCUMENTS

| | | | |
|---|---|---|---|
| 3,716,325 | 2/1973 | Aspland | 8/37 |
| 3,775,047 | 11/1973 | Weston | 8/37 |
| 3,944,382 | 3/1976 | Doerr | 8/34 |
| 4,011,042 | 3/1977 | Stitzel | 8/34 |
| 4,012,192 | 3/1977 | Doerr | 8/34 |

*Primary Examiner*—Joseph L. Schofer
*Assistant Examiner*—A. L. Clingman
*Attorney, Agent, or Firm*—Arthur A. Jacobs

[57] ABSTRACT

A dye-bath oxidant comprising a mixture of bromate and iodate salts.

3 Claims, No Drawings

DYE-BATH OXIDANTS

This invention relates to dye-bath oxidants, and it particularly relates to a mixture of bromate and iodate salts.

Sulfur dyes and vat dyes are water insoluble dyes which possess the unique property of being reducible in alkaline solution to water soluble materials called "leuco" compounds. A leuco compound must be highly substantive to natural and/or synthetic fibers if it is to become an effective dye. The reducing agents that are used are, generally, sodium sulfide or sodium hydrosulfite.

In the dye bath, the reduced dye diffuses into the fiber and becomes bonded to it by hydrogen bonding and/or by the action of van der Waals forces. After exhaustion of the leuco compound onto the fibers, the reduced dye is then oxidized in acid solution back to its original insoluble form and color. However, at this stage, the dye is "fast" because it is mechanically trapped within the fiber.

Oxidation is accomplished, generally, at the pH range of 4–5, although a wider range is also effective if the solution is acidic. Usually, acetic acid or formic acid is used to acidify the alkaline dye bath, with acetic acid being favored if the dyeing temperatures exceed about 150° F.

In principle, any oxidizing agent which does not harm the fiber or which does not alter the dye may be used. However, every oxidizing agent that has heretofore been used in industrial dyeing has a chemical, physical, economic or ecological limitation or shortcoming.

Air or hydrogen peroxide, for example, seldom oxidize the leuco compound completely during the dyeing process, especially with the heavy shades, because they react very slowly, even at higher temperatures. Therefore, spontaneous air oxidation often continues long after the commercial dyeing process is terminated. This causes subsequent color changes in the dyed fiber. Furthermore, since the non-oxidized leuco compounds are water soluble, incompletely oxidized fabrics are not fast to laundering.

Sodium nitrite has also been used as an oxidant, but, it too, suffers from many shortcomings, among them being the release of noxious fumes of nitrogen oxides and the tendency to react chemically with the dye or leuco compound in reactions other than oxidation.

Heretofore, the oxidants that were generally used were salts of bichromate and, to a lesser extent, alkali metal salts of chromate, permanganate and perborate. However, because of the toxicological effects of these compounds, these chromium, manganese and boron compounds are ecologically unacceptable.

Two recently-proposed families of oxidants have the proper chemical properties to be useful in dyeing, and they possess the proper toxicological properties to be ecologically acceptable. They are the salts (usually the sodium or potassium salts) of iodate and bromate.

Iodates and bromates have been used individually and have enjoyed some success in commercial dyeing. However, each class of compound, used individually, has its own shortcomings and practical limitations. Iodates, for example, are costly; and the need to use iodates as oxidants in the dyeing of low-cost textiles often creates an economic hardship. Bromates are relatively less expensive than iodates; however, when dissolved in a bath at acid pH, at temperatures above about 130° to 140° F., they liberate elemental bromine during the dyeing process. This causes the release of large volumes of noxious bromine fumes and also causes corrosion of the dyeing equipment, since free bromine is a highly corrosive material.

In accordance with the present invention, it has now been discovered that the addition of relatively small quantities of the iodate to the bromate, amounting to about 25% of the weight of the bromate, results in a mixture which is a highly effective oxidant for dyeing without resulting in the liberation of elemental bromine.

A mixture of about 4 parts of sodium or potassium bromate and one part of sodium or potassium iodate, when used as an oxidant in dyeing, at a concentration of about 0.05 to 0.30 ounces per gallon of aqueous dye bath, at a pH of from about 4 to about 5, and at a temperature above 100° F., serves as a highly effective oxidant. Furthermore, and, quite surprisingly and unpredictably, it does not release elemental bromine during the dyeing process, even at temperatures above 140° F., so that there is no liberation of noxious bromine fumes and no apparent corrosion of dyeing equipment.

Although the reason for the above is not readily apparent and although there is no intent to be bound by any theoretical hypothesis, it appears that the following series of chemical reactions occur:

When bromates oxidize the leuco compounds in acid solution, they are, in turn, reduced to bromide ions, according to the equation:

$$BrO_3^- \rightarrow 3[0] + Br^-$$

In the presence of unreacted bromate, bromide is oxidized to elemental bromine, according to the equation:

$$BrO_3^- + 5B_R^- + 6H^+ \rightarrow 3Br_2 + 6H_2O$$

The volatile bromine vapors account for the noxious fumes, and the bromine, in or out of solution, accounts for corrosion of equipment.

In similar fashion, when iodates are used to oxidize leuco compounds, they are reduced to iodide ions:

$$IO_3^- \rightarrow 3[O] + I^-$$

Iodide ions are not readily oxidized to free iodine by iodate. However, free bromine is such a powerful oxidizing agent that it can easily oxidize the iodide ion to iodate ion in acid solution, according to the equation:

$$3Br_2 + 3H_2O + I^- \rightarrow IO_3^- + 6H^+ + 6Br^-$$

In this manner, free bromine is converted to bromide ions.

Therefore, when iodates and bromates are used simultaneously as dye oxidants, and are, in turn, reduced to iodide and bromide ions, only the bromide ion is oxidized to free elemental bromine by bromate, while the iodide ion is apparently not oxidized to free elemental iodine. If a small quantity of iodide happens to be oxidized to iodine, it will not have a deleterious effect on the dyeing, because iodine is insoluble in water. However, at no time, is the free bromine present in sufficient concentration in the dye bath to become bothersome as a noxious gas or as a corrosive material, since shortly after being liberated by one chemical reaction, it is reduced to bromide by another chemical reaction when it oxidizes iodide to iodate. This reconversion of iodide to iodate permits the product to act as a cyclic oxidant, alternating between the iodide form and iodate form.

In order to test the hypothesis explaining the actual chemical behavior of mixtures of iodate and bromate during the dyeing process, an experimental technique, embodied in the following tests, was used:

About 40 mg. of a solid oxidant and about 40 mg. of solid sodium sulfite were dissolved in about 100 ml. of water and acidified to a pH of about 4 with either acetic or formic acid in a large test tube. The solution was underlayed with about 5 ml. of carbon tetrachloride, warmed in hot water to about 100° to 140° F., and shaken.

This test was performed separately on the following oxidants: bromates alone, iodates alone, and separate mixtures of bromates and iodates having approximately 4:1, 1:1 and 2:3 ratios of bromate to iodate. These concentrations approximated he lowest concentration of the reactants in the dye bath under actual dyeing conditions.

A purple color in the carbon tetrachloride would indicate the liberation of free iodine. A red-brown-orange color in the carbon tetrachloride would indicate the liberation of bromine. The purpose of the sodium sulfite was to act as a reducing agent to simulate the chemical action of a leuco compound.

The same tests were then repeated using about 300 mg. of solid oxidant and 300 mg. of solid sodium sulfite in about 100 ml. of water. These concentrations approximated the highest concentration of reactants in the dye bath under actual dyeing conditions.

The test results showed that when bromates alone were used as oxidants at both lower and higher concentrations, free bromine is liberated in large quantities, as evidenced by the red-brown color in the carbon tetrachloride.

When iodates alone were used as oxidants, iodine was seldom liberated, as evidenced by the lack of color in the carbon tetrachloride solution. A purple color usually failed to appear in the carbon tetrachloride even when 300 mg. of pure iodate was used as the oxidant.

When test quantities of oxidant of from 40 to 300 mg., comprising mixtures of iodate and bromate in ratios of between 20–60% iodate and 80–40% bromate were used, no color was produced in the carbon tetrachloride layer. This indicated that no detectable free bromine was produced when mixtures of bromate and iodate were used as oxidants.

As a control and check on the test method, when an excess of free chlorine was introduced into the test solutions, after the test was completed, iodine was liberated from the iodate test solutions and bromine was liberated from the iodate-bromine test solutions. This was in accordance with the well known fact that chlorine liberates bromine from bromide solutions and iodine from iodide solutions, and proved that bromine and iodine could be liberated from the test solutions.

In some tests with pure iodate, or where the concentration of iodate was about 50% or more of the total oxidant, the carbon tetrachloride layer developed a very faint violet cast. This indicated that at high iodate concentrations, some free iodine might be liberated. However, the lack of yellow, orange or red color indicated that there was no simultaneous release of free bromine.

Sodium iodate is a fine, white, crystalline salt which is not deliquescent; however, it cakes upon standing for long periods of time and begins to pack after standing exposed for 2 or 3 days. After caking or packing, sodium iodate does not flow freely unless it is agitated before blending until the clumps have been destroyed.

The discovery that mixtures of sodium bromate and either sodium or potassium iodate, in which the iodate content is from 20 to 60% by weight, do not pack, cake or clump, even after standing exposed for long periods of time, permits storage or long distance shipping of the product without fear that it will lose its free-flowing property.

The invention claimed is:

1. A dye bath oxidant for leuco sulfur or vat dyes after said dyes have been adsorbed on fibers, said oxidant consisting essentially of about 40–80 parts by weight alkali bromate and about 20–60 parts by weight alkali iodate, the alkali in each instance being selected from the group consisting of sodium and potassium.

2. A method of oxidizing leuco sulfur or vat dyes after said dyes have been adsorbed on fibers which comprises applying to said dyes, in acid dye bath, an oxidizingly effective amount of an oxidizing agent consisting essentially of about 40–80 parts by weight alkali bromate and about 20–60 parts by weight alkali iodate, the alkali in each instance being selected from the group consisting of sodium and potassium.

3. The method of claim 2 wherein the oxidizing agent is applied at a temperature above about 130° F.

* * * * *